United States Patent [19]

Zinsmeyer et al.

[11] Patent Number: 4,997,340

[45] Date of Patent: Mar. 5, 1991

[54] BALANCE PISTON AND SEAL ARRANGEMENT

[75] Inventors: Thomas M. Zinsmeyer, Pennellville; Vishnu Sishtla, Syracuse, both of N.Y.

[73] Assignee: Carrier Corporation, Syracuse, N.Y.

[21] Appl. No.: 412,076

[22] Filed: Sep. 25, 1989

[51] Int. Cl.[5] ..... F01D 3/00

[52] U.S. Cl. ..... 415/105; 415/111; 417/423.11

[58] Field of Search ..... 415/104, 105, 107, 110, 415/111, 112, 170.1, 174.5, 122.1, 124.1, 124.2, 229, 230; 417/365, 366, 373, 372, 423.6, 423.9, 423.11; 277/53

[56] References Cited

U.S. PATENT DOCUMENTS

| | | | |
|---|---|---|---|
| 1,499,056 | 6/1924 | Hollander | 415/104 |
| 1,910,811 | 5/1933 | Peterson | 415/170.1 |
| 2,799,227 | 7/1957 | Allen | 417/365 |
| 2,973,135 | 2/1961 | Greenwald | 415/105 |
| 3,895,689 | 7/1975 | Swearingen | 415/104 |
| 3,933,416 | 1/1976 | Donelian | 417/372 |
| 3,976,390 | 8/1976 | Silvern et al. | 415/122.1 |
| 4,472,107 | 9/1984 | Chang et al. | 415/104 |
| 4,614,482 | 9/1986 | Gaffal | 417/373 |
| 4,688,989 | 8/1987 | Kondo et al. | 415/124.2 |
| 4,884,942 | 12/1989 | Pennink | 415/104 |

*Primary Examiner*—Edward K. Look
*Assistant Examiner*—Hoang Nguyen
*Attorney, Agent, or Firm*—Dana F. Bigelow

[57] ABSTRACT

A labyrinth seal is provided to isolate the transmission from a balance piston of a centrifugal compressor, the labyrinth seal being pressurized with refrigerant vapor from the motor chamber, which vapor is at a pressure slightly above that in the transmission, to thereby minimize the efficiency losses that would otherwise occur from leakage of the vapor into the transmission and to the compressor suction.

9 Claims, 2 Drawing Sheets

BALANCE PISTON AND SEAL ARRANGEMENT

BACKGROUND OF THE INVENTION

This invention relates generally to centrifugal compressors and, more particularly, to a method and apparatus for providing a seal between an oil-fed transmission chamber and the relatively low pressure area in a balance piston adjacent the impeller.

In order to counteract the aerodynamic thrust that is developed by the impeller of a centrifugal compressor, it is well known to employ a balance piston consisting of a low pressure cavity behind the impeller wheel. Because of the tendency for lubricating oil to leak from the transmission into this low pressure area, it is also common practice to install a seal device between the balance piston and the transmission. A mechanical seal, such as a carbon face seal, is typically used for this purpose. However, besides being very intricate, delicate and expensive, these mechanical seals introduce substantial mechanical losses due to viscous drag from relative motion between mating surfaces.

An alternative is a labyrinth seal which is simple, rugged, inexpensive and, since it is noncontacting, there is virtually no mechanical losses due to rubbing. The disadvantage, however, is that in order to be entirely effective, it is necessary to pressurize the labyrinth seal. One known way to do so in a centrifugal compressor is to fluidly connect a source of high pressure gas from the discharge line to the center of the labyrinth. In this way, oil leakage from the transmission is substantially eliminated.

A disadvantage of such a pressurized labyrinth seal as recognized by the Applicants is that the high pressure gas at the labyrinth will tend to flow into the balance piston and the transmission chamber, and if the flow becomes excessive, the overall efficiency of the compressor will suffer. Further, the flow into the balance piston will tend to degrade its performance.

In particular, with regard to efficiency losses in higher pressure systems, such as a centrifugal compressor designed for an operation with a high density refrigerant such as R-22, the pressure differential between the compressor discharge line and the transmission, and even more so, the pressure differential between the discharge line and the balance piston, can be sufficiently high that there will be a substantial flow of refrigerant gas to the balance piston and into the transmission. The transmission is vented by means of a pipe back to compressor suction. Also, the balance piston is ported to compressor suction. Thus, any high pressure gas leaking in either direction ends up being re-compressed and is therefore cause for a loss in efficiency.

It is therefore an object of the present invention to provide an improved labyrinth seal arrangement for a centrifugal compressor.

Another object of the present invention is the provision in a centrifugal compressor for the effective and efficient use of a balance piston.

Yet another object of the present invention is the provision in a centrifugal compressor for maintaining an effective and efficient seal between the transmission and a low pressure cavity of a balance piston structure.

Still another object of the present invention is the provision in a centrifugal compressor for reducing the leakage of high pressure labyrinth seal gas to a balance piston cavity.

Yet another object of the present invention is the provision in a centrifugal compressor for a labyrinth seal arrangement which is economical to manufacture and reliable and effective in use.

These objects and other features and advantages become more readily apparent upon reference to the following description when taken in conjunction with the appended drawings.

SUMMARY OF THE INVENTION

Briefly, in accordance with one aspect of the invention, a labyrinth seal, between the transmission and balance piston of a centrifugal compressor, is pressurized by a source of pressurized gas which is maintained at a pressure slightly above the pressure in the transmission. This slight pressure differential is sufficient to prevent oil from migrating out of the transmission and yet is not so great as to cause excessive amounts of gas to flow into the balance piston and transmission.

By another aspect of the invention, the gas which is supplied to pressurize the labyrinth is taken from a motor chamber which is vented to the cooler. Refrigerant gas, generated in the motor chamber during the motor cooling process, is allowed to flow to the cooler in a manner controlled by a back-pressure valve. This valve acts to maintain a fixed pressure differential between the motor shell and the cooler and to thus provide a source of pressurized gas to the labyrinth seal at a pressure that is slightly above that in the transmission and not significantly higher than that in the balance piston.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
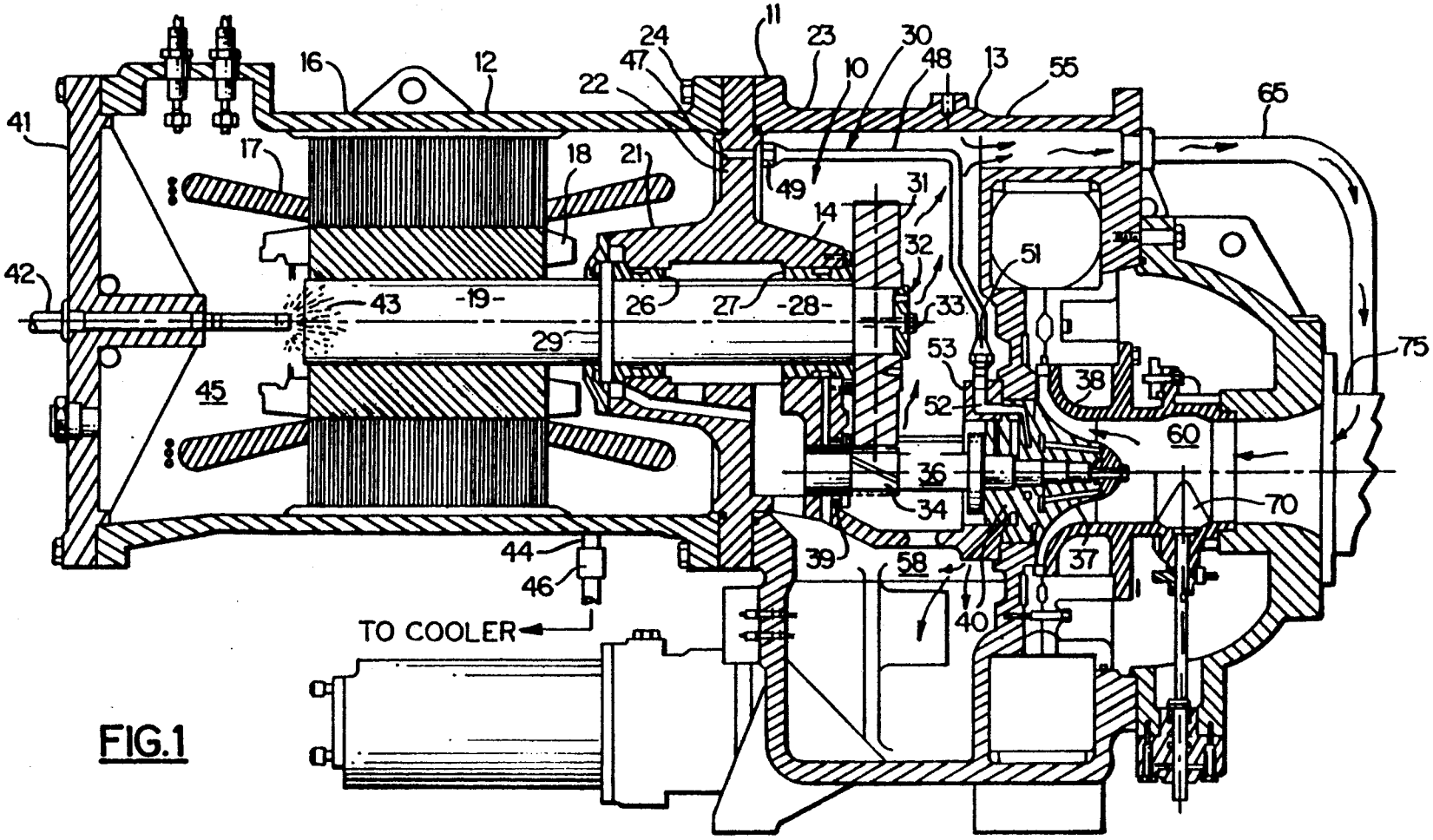
FIG. 1 is a longitudinal cross-sectional view of a centrifugal compressor having the balance piston and seal arrangement of the present invention incorporated therein.

Referring now to FIG. 1, the invention is shown generally at 10 as embodied in a centrifugal compressor system 11 having an electric motor 12 at its one end and a centrifugal compressor 13 at its other end, with the two being interconnected by a transmission 14.

The motor 12 includes an outer casing 16 with a stator coil 17 disposed around its inner circumference. The rotor 18 is then rotatably disposed within the stator winding 17 by way of a rotor shaft 19 which is overhung from, and supported by, the transmission 14. The transmission 14 includes a transmission case 21 having a radially extending annular flange 22 which is secured between the motor casing 16 and the compressor casing 23 by a plurality of bolts 24, with the transmission case 21 and the compressor casing partially defining a transmission chamber 30.

Rotatably mounted within the transmission case 21, by way of a pair of axially spaced bearings 26 and 27 is a transmission shaft 28 which is preferably integrally formed as an extension of the motor shaft 19. The collar 29, which is an integral part of the shaft or attached by shrink fitting, is provided to transmit the thrust forces from the shaft 28 to the thrust bearing portion of the bearing 26. The end of shaft 28 extends beyond the transmission case 21 where a drive gear 31 is attached thereto by way of a retaining plate 32 and a bolt 33. The drive gear 31 engages a driven gear 34 which in turn drives a high speed shaft 36 for directly driving the compressor impeller 37. The high speed shaft 36 is supported by journal bearings 39 and 40.

In order to reduce windage losses in the transmission 14 and to prevent oil losses from the transmission chamber 30, the transmission chamber 30 is vented to the lowest pressure in the system (i.e., compressor suction pressure) by way of passage 55, tube 65, and compressor suction pipe 75. As will be explained hereinafter, this flow path can be a cause of lost efficiency unless provision is made in accordance with the present invention.

In order to cool the motor 12, liquid refrigerant is introduced from the condenser (not shown) into one end 41 of the motor 12 by way of an injection port 42. Liquid refrigerant, which is represented by the numeral 43, enters the motor chamber 45 and boils to cool the motor 12, with the refrigerant gas then returning to the cooler by way of a conduit 44. A back pressure valve 46 is included in the conduit 44 in order to maintain a predetermined pressure differential (i.e., about 5–6 psi) between the motor chamber 45 and the cooler, which typically operates at about 80 psia. Compressor suction pipe 75, at the point where transmission vent tube 65 is connected, is typically at a pressure 1–2 psi less than the cooler. This establishes a transmission pressure of about 78–79 psia. Thus, the pressure in the motor chamber is maintained at 85–86 psia, which is about 6–8 psia or 7.6–10.3% above that in the transmission chamber 30.

Figure 2:
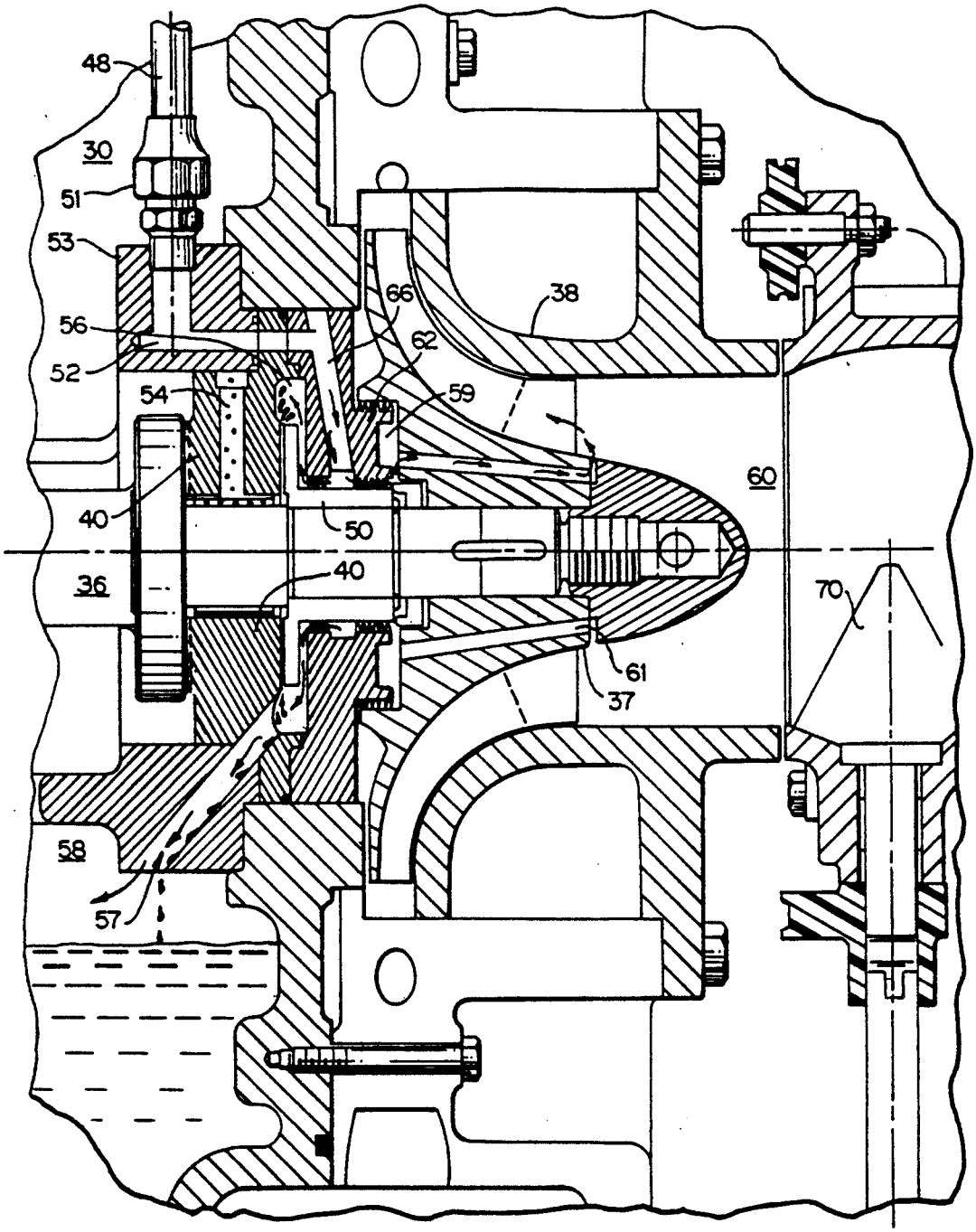
FIG. 2 is an enlarged view of a portion thereof showing details of the labyrinth seal portion of the invention.

Also, fluidly communicating with the motor chamber 45 is an opening 47 in the annular flange 22 of the transmission case 21. A line 48 is attached at its one end to the opening 47 by way of a standard coupling member 49. At the other end of the line 48 is a coupling member 51 which fluidly connects the line 48 to a passage 52 formed in flange member 53 as shown in FIG. 1 and as can be better seen in FIG. 2. The bearing 40 functions as both a journal bearing to maintain the radial position of the shaft 36 and as a thrust bearing to maintain the axial position thereof. An oil feed passage 54 is provided as a conduit for oil flowing radially inwardly to the bearing surfaces, and an oil slinger 50 is provided to sling the oil radially outward from the shaft 36. An annular cavity 56 then functions to receive the oil which is slung off from the bearing 40 and to facilitate the drainage of oil through a passage 57 and back to the sump 58. It is this path which, together with the flowpath mentioned above, can be a cause of loss in efficiency unless corrective provisions are made as will be described hereinafter.

In order to provide a counteraction to the aerodynamic thrust that is developed by the impeller 37, a "balance piston" is provided by way of a low pressure cavity 59 behind the impeller wheel 37. A passage 61 is provided in the impeller 37 in order to maintain the pressure in the cavity 59 at the same low pressure as the compressor suction indicated generally by the numeral 60. This pressure (downstream of the guide vanes 70) typically varies from around 77 psia at full load, down to 40 psia at 10% load. Since the pressure in the transmission casing is higher (i.e., equal to the compressor suction pressure upstream of the inlet guide vanes 70, or about 78–79 psia) than that in the cavity 59, and especially at part load operation, a labyrinth seal 62 with its associated teeth 63 is provided between the bearing 40 and the impeller 37 to seal that area against the flow of oil from the transmission into the balance piston 59. This concept is well known as is the further concept of pressurizing the labyrinth seal by exerting a high pressure gas thereon. If, as is customary, high pressure gas from the discharge line is used to pressurize the labyrinth seal 62, then the substantial pressure differential will cause the high pressure vapor, (i.e. around 200 psia) to flow from the labyrinth seal 62 to the low pressure sections of the system to thereby reduce the efficiency thereof. This flow can occur in two directions as indicated by the arrows in FIGS. 1 and 2. It can flow along passage 61 to the compression suction 60 or it can flow along passage 57 to the sump 58, from where it can flow as indicated by the arrows in FIG. 1, through the vent opening 55, the tube 65, the suction pipe 75 and finally to the compressor suction 60. In order to prevent these losses, the labyrinth seal 62 has instead, been pressurized with the refrigerant vapor in the motor chamber 45, which vapor passes through the line 48, the passage 52, and a passage 66 in the labyrinth seal 62. Thus, the labyrinth seal 62 is pressurized at the motor casing pressure of 85–86 psia, which is 6–8 psi above the transmission pressure. With this pressure differential being so minimized, the losses that would result from the labyrinth pressurization gas leaking back into the transmission and eventually into the compressor suction 60 is therefore also minimized. Similarly, with the pressure differential between the labyrinth seal 62 and the compressor suction 60 being minimized, the losses that result from the leakage of labyrinth pressurization gas leaking directly into the compressor suction 60 by way of the passage 61 is also minimized.

It will therefore be seen that the present invention not only provides the advantages of using a labyrinth seal for isolating the transmission chamber 30 from a balance piston in a centrifugal compressor, but also provides a novel and practical means of pressurizing the labyrinth seal in a manner which optimizes the efficiency of the system.

While the present invention has been disclosed with particular reference to a preferred embodiment, the concepts of this invention are readily adaptable to other embodiments, and those skilled in the art may vary the structure thereof without departing from the essential spirit and scope of the invention.

What is claimed is:

1. An improved seal arrangement for a centrifugal compressor of the type having a balance piston to counteract the thrust load on the impeller, a labyrinth seal interposed between the balance piston and a transmission chamber, and a source of pressurized gas to pressurize the labyrinth seal, comprising:

a source of pressurized fluid which is maintained at a pressure that is slightly above the pressure in the transmission chamber; and a conduit which fluidly interconnects said source of pressurized fluid to the labyrinth seal.

2. An improved seal arrangement as set forth in claim 1 wherein said compressor is driven by an electric motor which is cooled by refrigerant injected into its chamber and wherein said source of pressurized fluid is the motor chamber.

3. An improved seal arrangement as set forth in claim 1 wherein said source of pressurized fluid is maintained at a pressure in the range of 7.6–10.3% greater than that in the transmission chamber.

4. An improved labyrinth seal arrangement of the type disposed between an oil containing transmission chamber and a balance piston of a centrifugal compressor comprising:

a source of vapor at a pressure slightly greater than the pressure in the transmission chamber, and fluid communication means for fluidly interconnecting said source to the labyrinth seal for pressurizing said seal and preventing the flow of oil from the transmission chamber to the balance piston.

5. An improved labyrinth seal as set forth in claim 4 wherein said compressor is driven by an electric motor which is cooled by refrigerant injected into its chamber and wherein said source of vapor is the motor chamber.

6. An improved labyrinth seal as set forth in claim 4 wherein said source of vapor is maintained at a pressure in the range of 7.6–10.3% greater than that in the transmission chamber.

7. An improved method of pressurizing a labyrinth seal of the type disposed between an oil containing transmission chamber and a balance piston of a centrifugal compressor comprising the steps of:

establishing a source of vapor at a pressure slightly above the pressure in the transmission; and fluidly interconnecting said source to said labyrinth seal so as to pressurize the seal and prevent the flow of oil from the transmission chamber to the balance piston.

8. The method as set forth in claim 7 wherein said source of vapor is at a pressure in the range of 7.6–10.3% greater than that in the transmission chamber.

9. The method as set forth in claim 7 and including the step of pressurizing a motor chamber and said motor chamber is used as said source of vapor.

* * * * *

UNITED STATES PATENT AND TRADEMARK OFFICE

CERTIFICATE OF CORRECTION

PATENT NO. : 4,997,340

DATED : March 5, 1991

INVENTOR(S) : Thomas M. Zinsmeyer, Vishnu Sishtla

It is certified that error appears in the above-identified patent and that said Letters Patent is hereby corrected as shown below:

TITLE PAGE:

[75] is corrected to read as follows:

Vishnu Sishtla, Syracuse
Thomas M. Zinsmeyer, Pennellville
both of New York.

Signed and Sealed this

Second Day of July, 1991

*Attest:*

HARRY F. MANBECK, JR.

*Attesting Officer*

*Commissioner of Patents and Trademarks*